US009228746B2

(12) United States Patent
Hughes et al.

(10) Patent No.: US 9,228,746 B2
(45) Date of Patent: Jan. 5, 2016

(54) HEATING DEVICE HAVING A SECONDARY SAFETY CIRCUIT FOR A FUEL LINE AND METHOD OF OPERATING THE SAME

(75) Inventors: Dennis R. Hughes, Hartford, WI (US); Hyungsik Lee, Mequon, WI (US)

(73) Assignee: AOS HOLDING COMPANY, Wilmington, DE (US)

( * ) Notice: Subject to any disclaimer, the term of this patent is extended or adjusted under 35 U.S.C. 154(b) by 2356 days.

(21) Appl. No.: 11/421,141

(22) Filed: May 31, 2006

(65) Prior Publication Data

US 2007/0281257 A1 Dec. 6, 2007

(51) Int. Cl.

| | |
|---|---|
| ***F23N 5/24*** | (2006.01) |
| ***F23N 5/10*** | (2006.01) |
| *F23N 5/02* | (2006.01) |
| *F23N 5/00* | (2006.01) |

(52) U.S. Cl.

CPC ..... *F23N 5/242* (2013.01); *F23N 5/102* (2013.01); *F23N 5/003* (2013.01); *F23N 2025/16* (2013.01); *F23N 2031/08* (2013.01); *F23N 2031/18* (2013.01); *F23N 2035/14* (2013.01)

(58) Field of Classification Search

USPC ..... 431/22, 54, 69, 70, 71, 77, 78, 80, 6, 431/75; 122/14.21, 504, 14.2, 14.3, 14.31; 137/66, 489, 614.19; 126/39 G, 42

See application file for complete search history.

(56) References Cited

U.S. PATENT DOCUMENTS

| | | | | | |
|---|---|---|---|---|---|
| 970,122 | A | | 9/1910 | Schmidt et al. | |
| 2,198,453 | A | * | 4/1940 | Mantz | 137/66 |
| 2,201,398 | A | * | 5/1940 | Grayson | 431/80 |
| 2,253,670 | A | * | 8/1941 | Wetzel et al. | 431/54 |
| 2,291,567 | A | * | 7/1942 | Wunsch et al. | 431/51 |
| 2,508,588 | A | | 5/1950 | Waltman | |
| 2,652,065 | A | * | 9/1953 | Kutzler | 137/66 |
| 2,746,534 | A | * | 5/1956 | Brooks et al. | 431/57 |
| 3,033,280 | A | * | 5/1962 | Dean | 431/59 |
| 3,445,174 | A | * | 5/1969 | Matthews | 431/59 |
| 3,556,117 | A | | 1/1971 | Katchka | |
| 3,630,648 | A | * | 12/1971 | Hulsman | 431/80 |
| 4,177,034 | A | * | 12/1979 | Jones | 431/264 |
| 4,207,912 | A | | 6/1980 | Ichikawa | |
| 4,257,758 | A | * | 3/1981 | Blomberg | F23N 5/105 431/27 |
| 4,285,662 | A | * | 8/1981 | Katchka et al. | 431/53 |
| RE30,936 | E | * | 5/1982 | Kmetz et al. | 431/22 |
| 4,638,789 | A | | 1/1987 | Ueki et al. | |
| 4,778,378 | A | * | 10/1988 | Dolnick et al. | 431/79 |
| 5,209,454 | A | | 5/1993 | Engdahl et al. | |
| 5,397,233 | A | * | 3/1995 | Eavenson et al. | 431/80 |
| 5,518,396 | A | * | 5/1996 | Muzzolini et al. | 431/80 |

(Continued)

OTHER PUBLICATIONS

Standard Gas System; http://www.rvmobile.com/TECH/TROUBLE/GASSYS.HTM; pp. 1-4; Printed Mar. 10, 2006; RV Mobile Inc., Everett, WA.

(Continued)

*Primary Examiner* — Steven B McAllister
*Assistant Examiner* — Desmond C Peyton
(74) *Attorney, Agent, or Firm* — Michael Best & Friedrich LLP

(57) ABSTRACT

A secondary safety circuit for a gas-fired device and method of operating the circuit. The secondary safety circuit includes a low-voltage direct current power source, a valve, and at least one sensor. The valve can be positioned in a pilot burner gas line. The secondary safety circuit ensures the valve is closed upon detecting an unsafe condition with the sensor.

14 Claims, 4 Drawing Sheets

(56) References Cited

U.S. PATENT DOCUMENTS

| | | | | |
|---|---|---|---|---|
| 5,591,024 | A * | 1/1997 | Eavenson et al. | 431/125 |
| 5,674,065 | A * | 10/1997 | Grando et al. | 431/54 |
| 5,722,823 | A * | 3/1998 | Hodgkiss | 431/43 |
| 5,797,358 | A | 8/1998 | Brandt et al. | |
| 5,896,089 | A | 4/1999 | Bowles | |
| 5,899,683 | A * | 5/1999 | Nolte et al. | 431/25 |
| 5,967,176 | A * | 10/1999 | Blann et al. | 137/489.5 |
| 6,065,484 | A * | 5/2000 | Bartel et al. | 137/66 |
| 6,139,311 | A * | 10/2000 | Bowman et al. | 431/278 |
| 6,164,958 | A * | 12/2000 | Huang et al. | 431/16 |
| 6,216,791 | B1 * | 4/2001 | Alhamad | 169/45 |
| 6,220,280 | B1 * | 4/2001 | Lai | 137/488 |
| 6,261,087 | B1 * | 7/2001 | Bird et al. | 431/80 |
| 6,648,627 | B2 | 11/2003 | Dane | |
| 6,666,174 | B1 * | 12/2003 | Lesage | 122/19.2 |
| 6,766,820 | B1 * | 7/2004 | Hoss | 137/66 |
| 6,938,637 | B2 | 9/2005 | McGill et al. | |
| 7,112,059 | B2 * | 9/2006 | Donnelly | 431/22 |
| 7,424,896 | B1 * | 9/2008 | Martin et al. | 137/312 |
| 2002/0094498 | A1 * | 7/2002 | Rodriguez-Rodriguez | F23N 5/203 431/18 |
| 2002/0121305 | A1 * | 9/2002 | Firestine | 137/592 |
| 2002/0134322 | A1 * | 9/2002 | Dolan | 122/504 |
| 2006/0234176 | A1 * | 10/2006 | Willms | 431/80 |

OTHER PUBLICATIONS

Office action from the Canadian Intellectual Property Office for Application No. 2,589,620 dated Jun. 19, 2013 (4 pages).

* cited by examiner

HEATING DEVICE HAVING A SECONDARY SAFETY CIRCUIT FOR A FUEL LINE AND METHOD OF OPERATING THE SAME

BACKGROUND

The invention relates to heating devices, and particularly, to gas heating devices. More particularly, the invention relates to safety circuits for control of gas heating devices.

Gas-fired heating devices, such as water heaters, often include a combustion chamber and air plenum disposed below a tank, such as a water tank. A gas manifold tube, an ignition source, a thermocouple, and a pilot tube typically extend into the combustion chamber. When the temperature of the water in the tank falls below a set minimum, fuel is introduced into the combustion chamber through the gas manifold tube and a burner element. This fuel is ignited by a pilot burner flame or the ignition source, and the flame is maintained around the burner element. Air is drawn into the plenum via an air inlet, and mixes with the fuel to support combustion within the combustion chamber. The products of combustion typically flow through a flue or heat exchange tube in the water tank to heat the water by conduction.

SUMMARY

In one embodiment, the invention provides a gas water heater which includes a burner, a gas valve coupled to the burner, a pilot light being operable to produce a flame, a pilot safety circuit, and a secondary safety circuit.

The pilot safety circuit can include a thermocouple thermally coupled to the pilot light and electrically coupled to the gas valve. The pilot safety circuit is configured to ensure the gas valve is closed in response to the flame extinguishing.

The secondary safety circuit can include a low-voltage power source distinct from the thermocouple and a safety device configured to issue a signal in response to a safety condition. The secondary safety circuit is configured to ensure the gas valve is closed in response to the safety device issuing the signal.

In another embodiment the invention provides a secondary safety circuit for use in a gas water heater. The gas water heater includes a burner, a gas valve, a pilot light, and a pilot safety circuit. The pilot safety circuit can include a thermocouple and is configured to ensure the gas valve is closed when a flame of the pilot light is extinguished. The secondary safety circuit can include a low-voltage direct current power source, which is distinct from the thermocouple, a safety device configured to issue a signal in response to a safety circuit, and a second valve connectable to the pilot light. The second valve is configured to ensure a gas flow to the pilot light is interrupted in response to the safety device issuing the signal.

In another embodiment the invention provides a method of controlling a gas water heater. The gas water heater includes a pilot light, a gas valve, and a secondary safety circuit, the secondary safety circuit having a low-voltage power source, a safety device, and a second valve coupled to the pilot light.

The method can include detecting a condition with the safety device, applying a voltage from the low-voltage power source to the second valve in response to detecting the condition, closing the second valve in response to applying the voltage, thereby ensuring a flame of the pilot is extinguished, detecting the extinguishing of the flame, and ensuring the gas valve is closed when the flame is extinguished.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
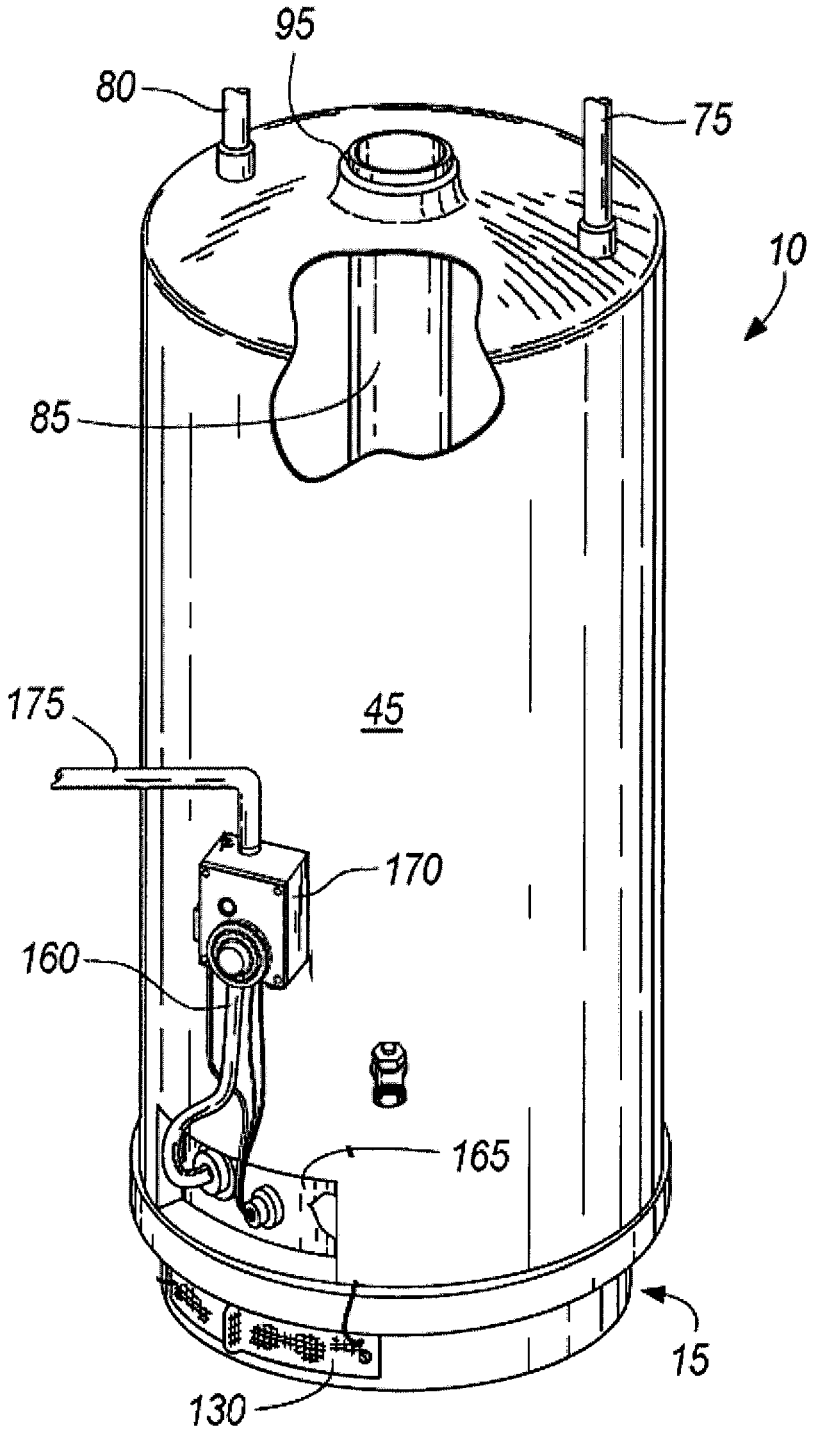
FIG. 1 is a perspective view of an exemplary construction of a water heater.
Figure 2:
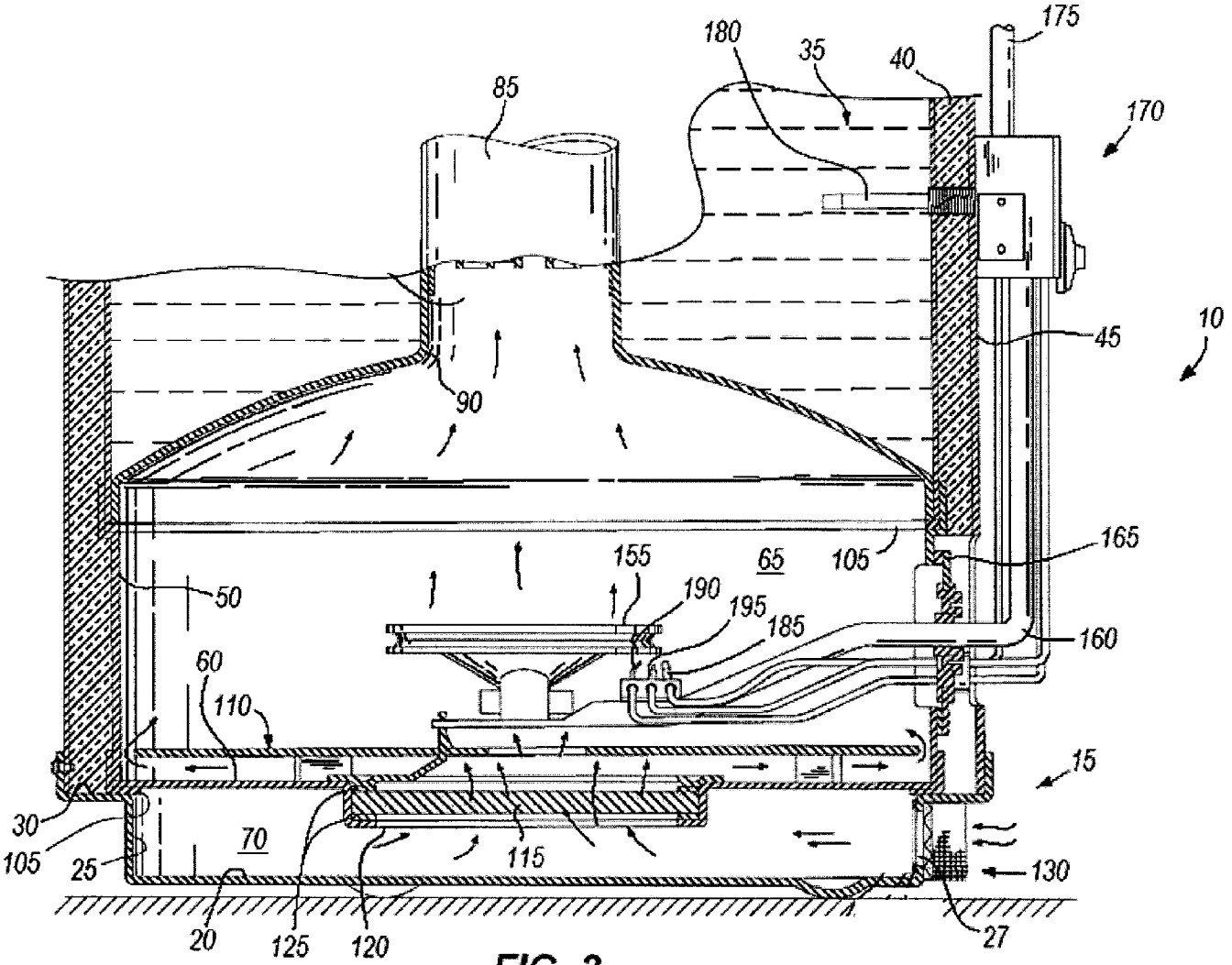
FIG. 2 is a sectional view of the bottom portion of the water heater of FIG. 1.

FIGS. 1 and 2 show an exemplary construction of a water heater having a non-powered gas valve/thermostat. As used in reference with FIGS. 1 and 2, the term "non-powered gas valve/thermostat" refers to a gas valve/thermostat that is not powered by the electrical mains. However and as will become more apparent below, the non-powered gas valve/thermostat is powered by one or more local power sources. Furthermore, it is contemplated that the gas valve/thermostat may be connected to the electrical mains in some constructions of the water heater.

Referring again to FIGS. 1 and 2 illustrate a storage-type gas-fired water heater 10 that includes a base pan 15 that provides the primary structural support for the rest of the water heater 10. The base pan 15 may be constructed of stamped metal or molded plastic, for example, and includes a generally horizontal bottom wall 20, a vertical rise 25 having an air inlet opening 27, and an elevated step 30. The water heater 10 also includes a water tank 35, insulation 40 surrounding the tank 35, and an outer jacket 45 surrounding the insulation 40 and the water tank 35. A skirt 50 is supported by the base pan's elevated step 30 and in turn supports the water tank 35. The elevated step 30 also supports the insulation 40 and jacket 45.

In addition, the elevated step 30 supports a divider 60 that divides the space between the bottom of the tank 35, skirt 50, and the base pan 15 into a combustion chamber 65 (above the divider 60) and plenum 70 (below the divider 60).

A cold water inlet tube 75 and a hot water outlet tube 80 extend through a top wall of the water tank 35. A flue 85 extends through the tank 35, and water in the tank 35 surrounds the flue 85. The flue 85 includes an inlet end 90 and an outlet end 95.

The combustion chamber 65 and plenum 70 space is substantially air-tightly sealed, except for the air inlet opening 27 and inlet end 90 of the flue 85, and seals 105 between the skirt 50 and the tank 35 and base pan 15 assist in sealing the space. The seals 105 may be, for example and without limitation, fiberglass material or a high-temperature caulk material. A radiation shield 110 sits on the divider 60 within the sealed combustion chamber 65 and reflects radiant heat up toward the tank 35.

A flame arrester 115 is affixed in a sealed condition across an opening 120 in the divider 60 such that all air flowing from the plenum 70 into the combustion chamber 65 should flow through the flame arrester 115. The air inlet 27, air plenum 70, and opening 120 in the divider 60 together define an air intake for the combustion chamber 65, and all air flowing into the combustion chamber 65 through the opening (see arrows in FIG. 2) 120 should flow through this air intake and the flame arrester 115. It should also be noted that the position and orientation of the flame arrester 115 are not limited to those shown in the drawings, and that substantially any construction will work provided that the flame arrester 115 acts as the gateway for the air flowing into the combustion chamber 65 from the plenum 70. Sealing members 125 seal the periphery of the flame arrester 115 to the divider 60 to reduce the likelihood of air circumventing the flame arrester 115. In alternative constructions, a single sealing member 125 may be used to seal the flame arrester 115 with respect to the divider 60, or if the flame arrester fits snugly against the divider 60, no sealing members 125 may be needed. The flame arrester 115 prevents flame within the combustion chamber 65 from igniting flammable vapors outside of the combustion chamber 65.

With reference again to FIG. 2, the air inlet 27 is covered by a screen 130 mounted to the outer surface of the base pan 15. The screen 130 filters air flow into the plenum 70 and reduces the likelihood that the flame arrester 115 will become occluded by lint or other debris.

A main burner 155 in the combustion chamber 65 burns a mixture of fuel and air to create the products of combustion that flow up through the flue 85 to heat the water in the tank 35. The main burner 155 receives fuel through a gas manifold tube 160 that extends in a sealed condition through an access door 165 mounted in a sealed condition over an access opening in the skirt 50.

The construction shown (illustrated in FIGS. 1 and 2), employs a non-powered gas valve/thermostat 170 mounted to the water tank 10. A gas main 175 provides fuel to the input side of the gas valve/thermostat 170. The gas valve/thermostat 170 includes a water temperature probe 180 threaded into the tank side wall 35. Connected to the output side of the gas valve/thermostat 170 are the burner manifold tube 160, a pilot burner 185, a thermocouple 190, and a spark igniter 195. The pilot burner 185, thermocouple 190, and spark igniter 195 extend into the combustion chamber 65 in a sealed condition through a grommet in the access door 165.

The gas valve/thermostat 170 provides a flow of fuel to the pilot burner 185 to maintain a standing pilot burner flame, and this construction is therefore generally referred to as a "continuous pilot ignition" system. The spark igniter 195 is used to initiate flame on the pilot burner 185 without having to reach into the combustion chamber with a match. A spark is generated by the spark igniter 195 in response to pushing a button on the gas valve/thermostat 170. The thermocouple 190 provides feedback to the gas valve/thermostat 170 as to the presence of flame at the pilot burner 185. More specifically, the gas valve/thermostat 170 includes an interrupter valve or some other means for selectively shutting off fuel flow to the pilot burner 185 and main burner 155. The interrupter valve is biased toward a closed position. The interrupter valve is held open by a voltage arising in the thermocouple 190 in response to the tip of the thermocouple 190 being heated by the pilot burner flame. If the pilot burner 185 loses its flame, the thermocouple 190 will cool down and not provide the voltage to the interrupter valve, and the interrupter valve will close and shut off fuel flow to the pilot burner 185 and main burner 155.

The gas valve/thermostat 170 permits fuel to flow to the main burner 155 in response to a water temperature sensor (e.g., the water temperature probe 180) indicating that the water temperature in the water tank 35 has fallen below a selected temperature. When fuel flows to the main burner 155, it is mixed with air and the mixture is ignited when it contacts the pilot burner flame. Once the water temperature sensor indicates that the water has reached the desired temperature, the gas valve/thermostat 170 shuts off fuel flow to the main burner 155, and the water heater 10 is in "standby mode" until the water temperature again drops to the point where the gas valve/thermostat 170 should again provide fuel to the main burner 155.

Figure 3:
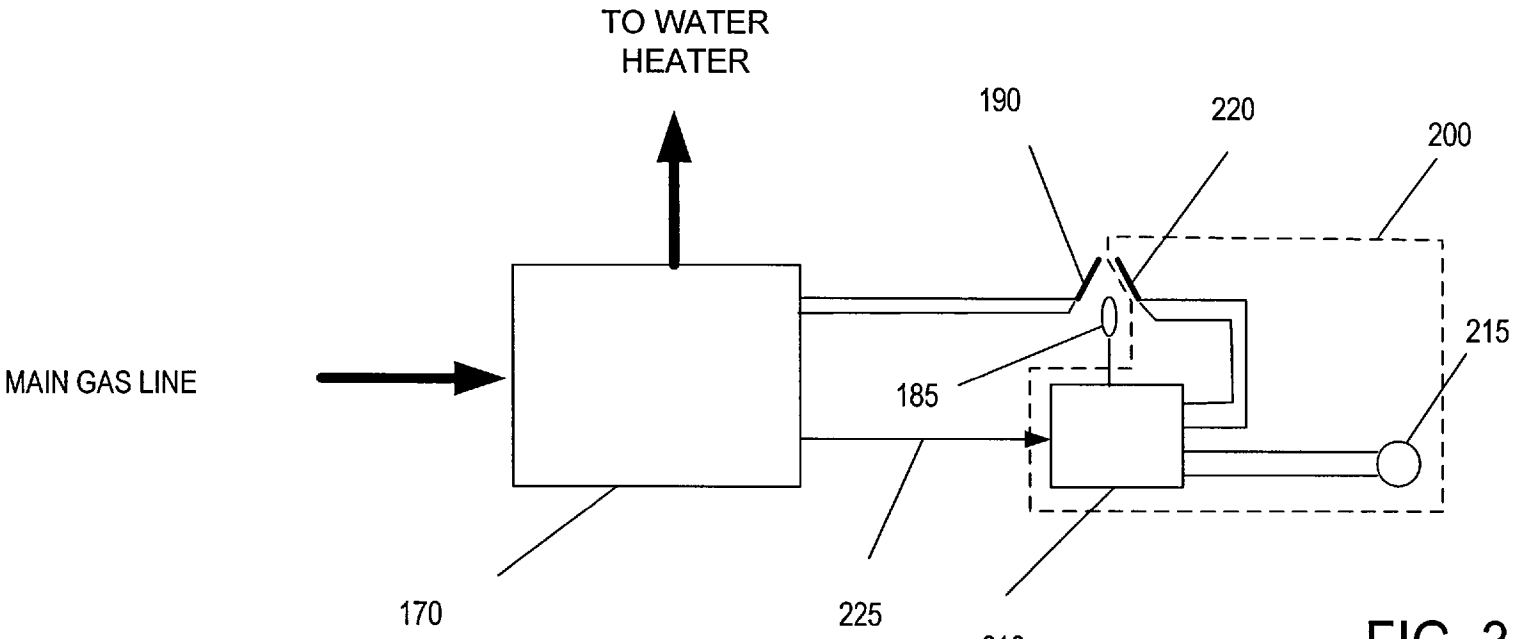
FIG. 3 is a partial block diagram/partial schematic of a construction of a secondary safety circuit.

FIG. 3 illustrates a partial block diagram/partial schematic of a construction of a secondary safety circuit 200 for a gas-fired water heater. The secondary safety circuit 200 can be included with the water heater at the time the water heater is manufactured or can be added to the water heater after the water heater has been in use. The secondary safety circuit 200 enables the interrupter valve to close and shut off fuel flow to the pilot burner 185 and main burner 155 upon the detection of additional unsafe or undesirable conditions beyond the extinguishment of the pilot burner flame. Safety conditions that can be detected include: the presence of carbon monoxide, water or gas leaks, excessive temperature, and oxygen depletion.

The secondary safety circuit 200 includes a low-voltage pulse actuated valve 210, at least one sensor 215, and a power source 220. The power source shown in FIG. 3 is a thermocouple, but other power sources are possible (such as a battery or similar low-voltage DC power source). The secondary safety circuit 200 operates in concert with the gas valve/thermostat 170 and its pilot safety circuit. The low-voltage pulse actuated valve 210 is positioned in the pilot gas line 225 between the gas valve/thermostat 170 and the pilot burner 185. The low-voltage pulse actuated valve 210 is a normally open valve which closes when actuated by a low-voltage pulse (e.g., 0.2 to 0.75 $V_{dc}$).

Once closed, the low-voltage pulse actuated valve 210 remains closed until it is opened manually by pressing a reset button while, at the same time, applying a voltage pulse of opposite polarity and substantially the same magnitude as the pulse used to close the valve 210. The pulse can be provided by an external battery or other suitable power source. In some constructions, the means for application of the pulse (e.g., terminals) for resetting the valve 210 can be hidden and require a qualified serviceman to reset the valve 210. Requiring a serviceman to reset the valve 210 can ensure that the safety condition which caused the valve 210 to close is repaired before the water heater is put back into service. Because the low-voltage pulse actuated valve 210 is a normally open valve, it requires no energy to remain open during normal operation.

In the construction shown in FIG. 3, the power source 220 is a thermocouple positioned adjacent the pilot burner flame. During normal operation, the pilot burner flame heats the thermocouple 220 providing power to the secondary safety circuit 200. In some constructions, the thermocouple can be positioned adjacent the burner 155 and can provide power to the secondary safety circuit 200 only when the burner 155 is operating.

When the low-voltage pulse actuated valve 210 receives a low-voltage pulse, it closes shutting off the supply of gas through pilot gas line 225 to the pilot burner 185. Shutting off the supply of gas to the pilot burner 185 results in the pilot burner flame extinguishing. Once the pilot burner flame extinguishes, the thermocouple 190 will cool and stop providing voltage to the interrupter valve. When the voltage provided by the thermocouple 190 to the interrupter valve drops below a threshold, the interrupter valve will close and fuel flow will be shut off to the main burner 155 and to the pilot burner 185. The thermocouple 220, of the secondary safety circuit 200, also cools and the voltage provided to the secondary safety circuit 200 drops. The loss of voltage has no impact on the secondary safety circuit 200 because the low-voltage pulse actuated valve 210 remains closed until it is manually reset.

Figure 4:
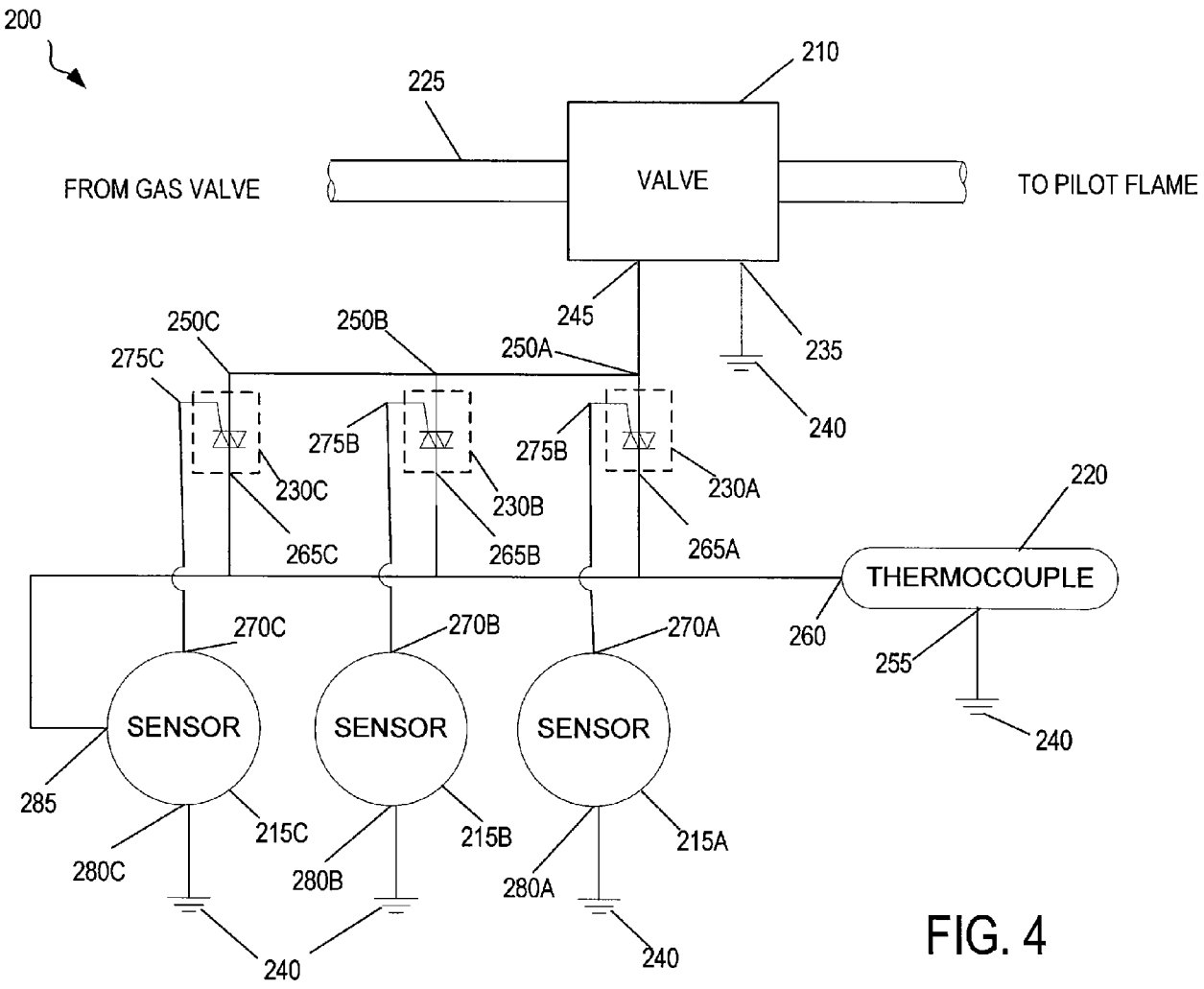
FIG. 4 is a partial block diagram/partial schematic diagram of a construction of a secondary safety circuit.

FIG. 4 is an illustration of a partial schematic/partial block diagram of a construction of a secondary safety circuit 200. The secondary safety circuit 200 includes a low-voltage pulse actuated valve 210, at least one sensor 215 (shown as 215A, 215B, and 215C), a thermocouple 220, and at least one comparator 230 (shown as 230A, 230B, and 230C).

The low-voltage pulse actuated valve 210 can have a first node 235 coupled to an electrical common 240 of the secondary safety circuit 200. The low-voltage pulse actuated valve 210 can also have a second node 245. The second node 245 can be coupled to an output 250 of the at least one comparator 230. When a voltage differential between the first node 235 and the second node 245 of the low-voltage pulse actuated valve 210 exceeds a threshold, the low-voltage pulse actuated valve 210 closes. When the low-voltage actuated valve 210 closes, it interrupts the flow of fuel in a pilot gas line 225, and extinguishes the pilot burner flame as discussed above. Once the safety condition that resulted in closing the low-voltage actuated valve 210 is corrected, the low-voltage actuated valve 210 is manually reset, as described above, to open the valve 210. In some embodiments, the valve 210 can reopen automatically when the safety condition is corrected and not require manual resetting.

The thermocouple 220 can have a negative node 255 coupled to common 240 of the secondary safety circuit 200 and a positive node 260 coupled to an input 265 of the at least one comparator 230. The thermocouple 220 produces a direct current voltage between its negative node 255 and its positive node 260 that is proportional to a temperature of the thermocouple 220.

The at least one sensor 215 can be self powered (sensors 215A and 215B) or can require an external power source (sensor 215C). The at least one sensor 215 has an output 270 which is coupled to a gate input 275 of the at least one comparator 230. When the voltage at the gate input 275 is below a threshold, the comparator 230 functions as an open switch preventing current applied to the input 265 from passing through to the output 250. When the voltage at the gate input 275 is above the threshold, the comparator 230 functions as a closed switch allowing current applied to the input 265 to pass through to the output 250.

The at least one sensor 215 can have a common node 280 coupled to the common 240 of the second safety circuit 200. If the sensor 215 requires an external power source (sensor 215C), the sensor 215 can have a power input node 285. The power input node 285 can be coupled to the positive node 260 of the thermocouple 220 (as shown in FIG. 4) or can be coupled to another external power source suitable for use with the sensor 215 (e.g., a battery).

When the sensor 215 detects a safety condition, the sensor 215 can provide a signal of the safety condition in the form of a voltage at its output 270. The sensor 215 can be configured as a switch such that, when the sensor 215 detects its condition, it outputs a voltage and when it does not detect its condition it outputs no voltage. The sensor 215 can also be configured as a sensor that outputs a voltage proportional to a severity of the condition it detects (e.g., a CO sensor that outputs an increasing voltage as a concentration of CO increases). The sensor 215 is configured such that when the sensor 215 detects a condition (or the severity of the condition exceeds a predetermined threshold), the sensor 215 provides a voltage to the gate input 275 of the comparator 230 sufficient to close the circuit and apply the voltage from the thermocouple 220 to the low-voltage actuated valve 210 and close the low-voltage actuated valve 210.

In some embodiments, the at least one sensor 215 includes a plurality of sensors wired in series such that all the sensors wired in series should detect one or more safety conditions before the secondary safety circuit 200 closes the low-voltage actuated valve 210.

In some embodiments, the low-voltage actuated valve 210 can be installed in a main the main gas line 175 and can interrupt fuel flow to the entire water heater 10 when a safety condition is detected.

In some constructions, a pulse actuated valve can be used which requires a relatively high voltage pulse (e.g., 24 $V_{dc}$) to close. A power source to provide the pulse can include a step-down transformer and a rectifier circuit powered by a 120 $V_{ac}$ line voltage.

While the secondary safety circuit has been described in relation to a water heater, the secondary safety circuit has application in any gas-fired device including a furnace, a stove, and a boiler. Further, the secondary safety circuit is not limited to gas-fired devices incorporating a pilot burner and associated safety circuit. Instead the secondary safety circuit can be power by a battery or external power source and can interrupt the main flow of fuel to the device. In addition, the secondary safety circuit can be used in any device in which a flow of fuel is required, including propane (e.g., barbeque grills) and gasoline (e.g., automobiles).

Thus, the invention provides, among other things, a secondary safety circuit for devices requiring a fuel supply. Various features and advantages of the invention are set forth in the following claims.

The invention claimed is:

1. A gas water heater comprising:

a burner;

a gas valve coupled to the burner;

a pilot light being operable to produce a flame;

a pilot safety circuit comprising a thermocouple thermally coupled to the pilot light and electrically coupled to the gas valve, the pilot safety circuit being configured to ensure the gas valve is closed in response to the flame extinguishing; and a secondary safety circuit comprising a low-voltage power source distinct from the thermocouple, and a safety detecting device distinct from and powered by the low-voltage power source, the safety detecting device configured to detect a safety condition different from the flame extinguishing detected by the pilot safety circuit, and to issue a signal in response to the safety condition, a second normally-open, magnetically-actuated gas valve coupled to the pilot light, the second normally-open, magnetically-actuated gas valve closing in response to receiving the signal from the safety detecting device.

2. The gas water heater of claim 1 wherein the pilot safety circuit is configured to ensure the gas valve is closed by being further configured to shut the gas valve when the gas valve is open.

3. The gas water heater of claim 1 wherein the safety detecting device comprises at least one of a carbon monoxide detector, a water leak detector, a gas leak detector, an excessive temperature detector, and an oxygen depletion detector.

4. The gas water heater of claim 1 wherein the low-voltage power source comprises a low-voltage, direct current power source.

5. The gas water heater of claim 4 wherein the low-voltage, direct current power source comprises at least one of a second thermocouple and a battery.

6. The gas water heater of claim 4 wherein the low-voltage, direct current power source comprises a second thermocouple thermally coupled to the pilot light, the second thermocouple being configured to generate power when heated by the flame.

7. The gas water heater of claim 1 wherein the second valve is coupled to the pilot light, the second valve being configured to ensure a gas flow to the pilot light is interrupted in response to the safety detecting device issuing the signal, thereby ensuring the flame is extinguished.

8. The gas water heater of claim 7 wherein the second valve comprises a magnetic valve.

9. The gas water heater of claim 8 wherein the magnetic valve is a normally open valve being configured to use substantially no power in its open position and closes when a small excitation voltage is applied.

10. The gas water heater of claim 9 wherein the magnetic valve is reset to its open position manually following an event wherein the magnetic valve is closed.

11. A method of controlling a gas water heater including a pilot light, a pilot safety circuit, a main burner, a gas valve, and a secondary safety circuit, the secondary safety circuit being distinct from the pilot safety circuit, the secondary safety circuit having a low-voltage power source, a safety detecting device, and a second valve coupled to the pilot light, the method comprising:

detecting a condition with the safety detecting device, the safety detecting device being distinct from and powered by the low-voltage power source;

issuing a signal in response to the condition with the safety detecting device;

applying a voltage from the low-voltage power source to the second valve in response to the signal;

closing the second valve in response to applying the voltage, thereby ensuring a flame of the pilot is extinguished;

detecting the extinguishing of the flame by the pilot safety circuit; and closing the gas valve by the pilot safety circuit when extinguishing of the flame is detected.

12. The method of claim 11 wherein the very low-voltage direct current is supplied by at least one of a thermocouple and a battery.

13. The method of claim 11 and further comprising detecting at least one of a presence of carbon monoxide, a water leak, a gas leak, an elevated temperature, and a lack of oxygen.

14. The method of claim 11 and further comprising retrofitting the secondary safety circuit onto an existing water heater.

* * * * *